US008884825B2

(12) United States Patent
Badaruzzaman et al.

(10) Patent No.: US 8,884,825 B2
(45) Date of Patent: Nov. 11, 2014

(54) MULTI-SLOT ANTENNA AND MOBILE DEVICE

(71) Applicant: BlackBerry Limited, Waterloo (CA)

(72) Inventors: Firass Mirza Badaruzzaman, Forest Park, IL (US); Michael Kühn, Bochum (DE); Shing Lung Steven Yang, San Diego, CA (US)

(73) Assignee: BlackBerry Limited, Waterloo (CA)

( * ) Notice: Subject to any disclaimer, the term of this patent is extended or adjusted under 35 U.S.C. 154(b) by 0 days.

(21) Appl. No.: 14/018,923

(22) Filed: Sep. 5, 2013

(65) Prior Publication Data

US 2014/0009354 A1 Jan. 9, 2014

Related U.S. Application Data

(63) Continuation of application No. 12/835,601, filed on Jul. 13, 2010, now Pat. No. 8,587,491.

(60) Provisional application No. 61/226,500, filed on Jul. 17, 2009.

(51) Int. Cl.

| | |
|---|---|
| ***H01Q 1/38*** | (2006.01) |
| ***H01Q 9/04*** | (2006.01) |
| ***H01Q 5/00*** | (2006.01) |
| ***H01Q 13/10*** | (2006.01) |
| ***H01Q 1/24*** | (2006.01) |

(52) U.S. Cl.

CPC ..... *H01Q 13/106* (2013.01); *H01Q 9/0421* (2013.01); *H01Q 5/0051* (2013.01); *H01Q 9/0471* (2013.01); *H01Q 13/10* (2013.01); *H01Q 1/243* (2013.01)

USPC ..... 343/700 MS; 343/767; 343/770

(58) Field of Classification Search

USPC ..... 343/700 MS, 767, 770

See application file for complete search history.

(56) References Cited

U.S. PATENT DOCUMENTS

| | | | | |
|---|---|---|---|---|
| 6,759,989 | B2 * | 7/2004 | Tarvas et al. | 343/700 MS |
| 6,759,991 | B2 * | 7/2004 | Boyle | 343/702 |
| 6,762,723 | B2 | 7/2004 | Nallo | |

(Continued)

FOREIGN PATENT DOCUMENTS

| | | | |
|---|---|---|---|
| DE | 10331281 | A1 | 2/2004 |
| EP | 1304765 | B2 | 4/2003 |
| EP | 1950833 | A1 | 7/2008 |
| WO | 2005018045 | A1 | 2/2005 |

OTHER PUBLICATIONS

Pentanova, Custom Penta-band antenna, v.7, May 7, 2008.

(Continued)

*Primary Examiner* — Douglas W Owens
*Assistant Examiner* — Jae Kim
(74) *Attorney, Agent, or Firm* — Ridout & Maybee LLP

(57) ABSTRACT

A mobile communications device having a patch antenna which has defined therein at least two slots each having two or more parts. The at least two slots may include an L-shaped slot and a C-shaped slot, wherein the slots can be open or closed. The L-shaped slot may be an open-slot projecting into the patch antenna from the edge. Ground and signal connections may be at the edge of the patch on either side of the L-shaped slot. The C-shaped slot may be nested within the L-shaped slot.

9 Claims, 9 Drawing Sheets

(56) References Cited

U.S. PATENT DOCUMENTS

| | | | | |
|---|---|---|---|---|
| 7,023,387 | B2 | 4/2006 | Wen | |
| 7,443,344 | B2 * | 10/2008 | Boyle | 343/700 MS |
| 7,466,271 | B2 | 12/2008 | Wen | |
| 2004/0145521 | A1 | 7/2004 | Hebron et al. | |
| 2007/0040751 | A1 * | 2/2007 | Boyle | 343/702 |
| 2008/0030411 | A1 | 2/2008 | Wen et al. | |
| 2009/0040110 | A1 | 2/2009 | Chien et al. | |
| 2009/0085812 | A1 | 4/2009 | Qi et al. | |
| 2011/0012790 | A1 | 1/2011 | Badaruzzaman et al. | |

OTHER PUBLICATIONS

Combined 4-band GSM and W-CDMA 2100 Antenna; W3530 Datasheet version 1.0; pulse finland oy, Sep. 2007.

Extended Euoprean Search Report; EP 10169439.6; Oct. 28, 2010.

* cited by examiner

MULTI-SLOT ANTENNA AND MOBILE DEVICE

CROSS-REFERENCE TO RELATED APPLICATIONS

The present application is a continuation of U.S. patent application Ser. No. 12/835,601, filed Jul. 13, 2010. U.S. patent application Ser. No. 12/835,601 claimed priority to U.S. Provisional Patent Application No. 61/226,500 filed Jul. 17, 2009. Both previously filed documents are hereby incorporated herein by reference.

FIELD

The present application generally relates to an antenna and, in particular, to a multi-slot antenna and a mobile device incorporating the multi-slot antenna.

BACKGROUND

Modern mobile communications devices are often equipped to operate on more than one frequency band. For example, some devices are capable of communicating on GSM-850 and GSM-1900. Yet other devices are capable of communication on GSM-900 and GSM-1800. Some tri-band devices, or even quad-band devices are configured to operate on three or four bands.

In addition, modern mobile communications devices are often multi-mode devices configured to communicate in more than one mode. For example, a multi-mode device may be configured to communicate with WWAN (wireless wide area networks) in accordance with standards such as GSM, EDGE, 3GPP, UMTS, etc., and may further be configured to communicate with WLAN (wireless local area networks) in accordance with standards like IEEE 802.11. Some devices are also equipped for short-range communications such as Bluetooth™. The multi-functionality of these devices often requires multiple antennas within the devices in order to communicate over the various frequency bands.

At the same time, the form factors for mobile communications devices are increasingly sleek and compact. This puts space within the device at a premium and makes it difficult to accommodate multiple antennas.

It would be advantageous to provide for an antenna that has a low profile but is capable of operating on multiple frequency bands.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

In one aspect, the present application describes a mobile communication device. The device includes a dielectric substrate having a surface; a radio frequency patch antenna formed from a conductive material on the surface of the substrate; a signal feed conductor connected to the patch antenna; and a ground conductor connecting the patch antenna to a ground plane. The patch antenna has defined therein at least two slots.

In another aspect, the present application describes a mobile communication device. The device includes a dielectric substrate having a surface; a radio frequency multi-band patch antenna formed from a conductive material on the surface of the substrate; a signal feed conductor connected to the patch antenna; and a ground conductor connecting the patch antenna to a ground plane. The patch antenna has defined therein a first slot and a second slot. The first slot and the second slot each have two or more parts.

In yet another aspect, the present application describes a multiband antenna that includes a dielectric substrate having a surface; a patch of conductive material on the surface of the substrate; a signal feed conductor connected to the patch; and a ground conductor connecting to the patch. The patch has defined therein at least two slots. The at least two slots each have two or more parts.

In some cases at least one part of each of the first and second slots is open to an edge of the patch. In some embodiments, the second slot is disposed on the patch between at least one of the parts of the first slot and the edge of the patch. In some embodiments, the signal feed conductor is connected to the patch between the first and second slots. In some embodiments, the signal feed conductor is connected to the edge of the patch between the parts of the respective first and second slot that are open to that edge.

In some embodiments, the first and second slots include an L-shaped slot and a C-shaped slot. In some embodiments, the L-shaped slot is an open slot projecting into the patch antenna from an edge. In some embodiments, the C-shaped slot is also an open slot projecting into the patch antenna from the edge. The signal feed conductor may be connected to the same edge of the patch antenna at a point between the L-shaped slot and the C-shaped slot. In some embodiments, the C-shaped slot is nested within the L-shaped slot.

Many electronic devices include an antenna for radio frequency communications, including mobile devices, laptop computers, desktop computers, smartphones, personal digital assistants, and many other such devices. Multi-mode or multi-band devices are configured to operate on more than one frequency band. Accordingly, such devices required more than one antenna or at least one antenna that is capable of operating on more than one band.

Figure 1:
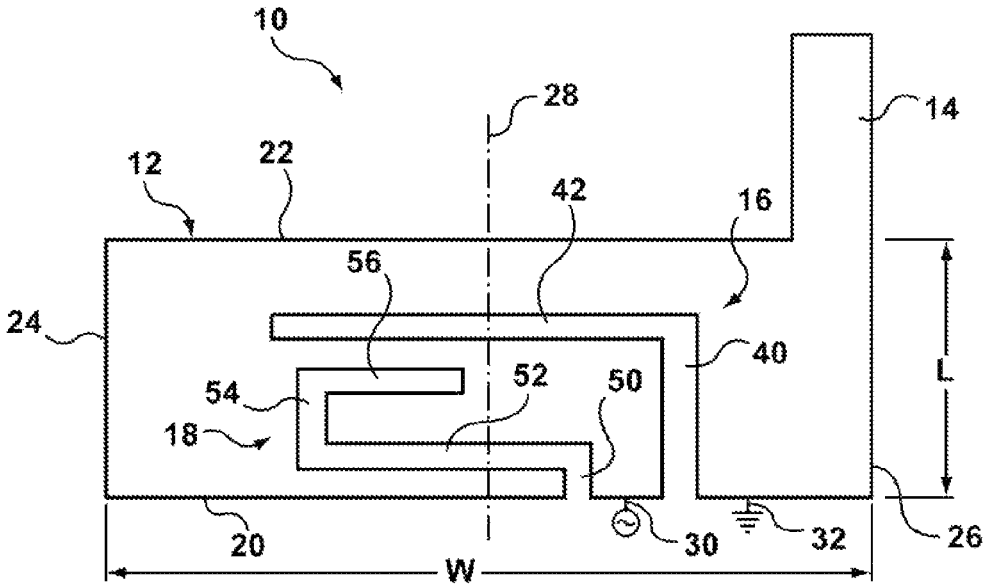
FIG. 1 diagrammatically shows an embodiment of an antenna.

Reference is now made to FIG. 1, which diagrammatically illustrates an example embodiment of an antenna 10. The antenna 10 is a low profile patch antenna formed from a conducting material, such as a metal. In this embodiment, the patch antenna 10 includes a main patch, formed as a generally rectangular portion 12 having a length L and width W. The generally rectangular portion 12 includes a lower edge 20, and upper edge 22, a left edge 24 and a right edge 26. In other embodiments, other shapes for the patch antenna may be used, including other polygonal shapes.

In this embodiment, a tuning stub 14 extends from one side of the rectangular portion 12. In this embodiment, the tuning stub 14 extends from the right side of the upper edge 22. The tuning stub 14 is integral with the rectangular portion 12 to form a single polygonal patch. The tuning stub 14 is placed and sized to tune the common mode resonance of the antenna 10, as will be described further below. Those ordinarily skilled in the art will appreciate that the patch antenna 10 need not necessarily include the tuning stub 14 and that the dimensions and shape of the patch may be adjusted to tune the common mode resonance of the antenna 10. Industrial design restrictions imposed by the form factor of the mobile device or other device in which the antenna 10 will be used may make use of the tuning stub 14 advantageous for those situations in which particular dimensions of the patch cannot be varied in a manner to achieve the desired resonance.

A signal feed conductor 30 connects to the lower edge 20 of the rectangular portion 12. The signal feed conductor 30 supply excitation current to the antenna 10 from driving circuitry, such as a transceiver (not shown). When used for reception, the signal feed conductor 30 conducts current induced in the antenna 10 by incident RF signals to receiving circuitry (not shown), such as a transceiver for filtering, amplification and demodulation. The signal feed conductor 30 in this embodiment connects to the lower edge 20 at a position to the right of the center of the rectangular portion 12. The centerline of the rectangular portion 12 is illustrated by a dashed line labeled 28. Although in the embodiments described herein the signal feed conductor 30 may be considered a microstrip-type direct feed connector, those ordinarily skilled in the art will appreciate that the signal feed conductor may be a different type of feed. For example, in some embodiments, a coax feed connector may be used. In yet other embodiments, an indirect coupling may be used, such as a capacitive or inductive coupling.

A ground conductor 32 also connects to the lower edge 20 of the rectangular portion 12. The ground conductor 32 connects to a ground plane (not shown). The ground plane is typically roughly parallel to and spaced apart from the antenna 10. In an electronic device, the antenna 10 may be supported by or mounted upon a non-conducting substrate of suitable dielectric material. The dielectric material may space the antenna 10 apart from an underlying ground plane in some embodiments.

Two or more slots (individually labeled 16 and 18) are formed in the generally rectangular portion 12. The two or more slots 16 and 18 each have two or more parts. The term "parts" in this context refers to the joined segments that make up the slot. In the embodiment shown the segments are straight-line segments or parts that are joined at right-angles; however, it will be understood that in some embodiments one or more parts may not be straight, and two parts may be joined at an angle other than a right angle. In some cases, a part may be curved or have a non-uniform width. In this embodiment, the slots are an L-shaped slot 16 and a C-shaped slot 18, and they extend from the lower edge 20 of the generally rectangular portion 12.

The slots 16 and 18 in this embodiment are of different length. Accordingly, they have different resonant frequencies; however, in this embodiment they are formed to have resonant frequencies sufficiently close that in combination they result in wideband performance for the antenna 10.

In this particular embodiment, the slots 16 and 18 are located on either side of the signal feed conductor 30. In particular, the L-shaped slot 16 extends from the lower edge 20 to the right of the signal feed conductor 30 and the C-shaped slot extends from the lower edge 20 to the left of the signal feed conductor 30. The L-shaped slot 16 has a first section 40 that extends upwards from the lower edge 20 in the direction of the upper edge 22, and a second section 42 that extends from the upper end of the first section 42 perpendicular to the first section 40 towards the left edge 24. The second section 42 in this embodiment extends beyond the centerline 28.

In this embodiment, the C-shaped slot 18 is an open C-shape facing towards the L-shaped slot 16. In particular, the C-shaped slot 18 includes a first portion 50 that extends perpendicularly from the lower edge 20 towards the upper edge 22. It then includes a second portion 52 that extends perpendicular to the first portion 50 towards the left edge 24. The second portion 52 extends beyond the centerline 28. The C-shaped slot 18 then includes a third portion 54 and a fourth portion 56 to form the C-shape.

In this embodiment, the C-shaped slot 18 is at least partly nested below or in the L-shaped slot 16. In particular, the C-shaped slot 18 is disposed between the second section 42 of the L-shaped slot 16 and the edge 20.

The length and relative positioning of the C-shaped slot 18 and L-shaped slot 16 produce two slot-based resonances that create a coupling effect that improves the impedance matching for the desired frequency bands to produce a wideband resonance for the antenna 10.

Because the slots 16, 18 are open at the edge 20, they are termed "open" slots, as opposed to "closed" slots. A "closed" slot is one located entirely within the boundaries or edges of the patch. In some embodiments, the C-shaped slot 18 may be a closed slot. The L-shaped slot 16 may, in some embodiments be a closed slot; however, in its location shown in FIG. 1 it serves to separate the current paths of the signal feed conductor 30 from the ground conductor 32. Accordingly, if the L-shaped slot 16 were made a closed slot, the signal feed conductor 30 or the ground conductor 32 may need to be relocated to another areas of the antenna 10. Such relocation, would, of course, alter the current paths and resulting resonances.

It will be appreciated that in other embodiments, different shaped slots may be used to realize different current paths, and that different shaped slots may result in positive or negative coupling of the respective resonances depending on their relative shapes and distances apart in terms of fractions of resonant wavelengths. The slots may be lengthened or shortened to tune the resonances to particular desired frequencies. Additional slots may be added to create additional resonances to support additional bands of operation, or to tune or increase the bandwidth of the wideband response. It will also be appreciated that additional elements, including parasitic patches may be added to further tune or shape the performance of the antenna 10.

The multi-band antenna 10 shown in FIG. 1 includes three resonances. The first resonance is a common mode resonance set by the dimensions of the generally rectangular portion 12 and the location of the signal feed conductor 30, and tuned by the tuning stub 14. The second and third resonances are slot resonances determined by the dimensions of the slots 16, 18. As noted above, if the dimensions are such that the resonances are somewhat close together in frequency, they merge to enable wideband communications.

In the embodiment illustrated in FIG. 1, the shape and configuration of the slots 16, 18 contributes to obtaining a positive coupling between the two slot resonances that improves the wideband performance of the antenna 10. In some other embodiments, the slots may be arranged such that they do not result in positive coupling and have more distinctive resonances.

The generally rectangular portion 12 has the left edge 24 and right edge 26 that respectively define a left portion and right portion on either side of the slots 16 and 18. The sizes of these portions or regions may be adjusted to tune the antenna 10. In particular, increasing or decreasing the size of the left portion or region may tune the common mode resonance. Increasing or decreasing the size of the right portion or region may tune the common mode resonance and the slot resonances.

Figure 2:
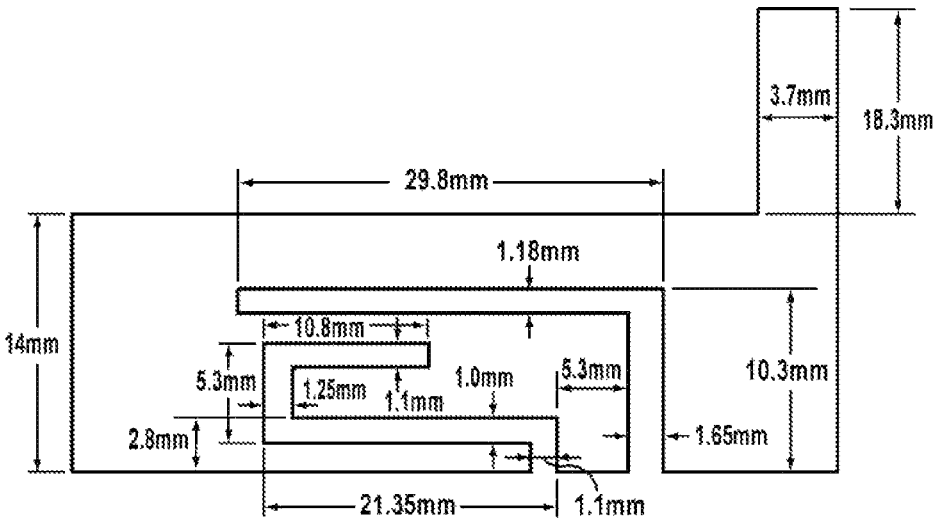
FIG. 2 shows a dimensioned illustration of an embodiment of the antenna.

Reference is now made to FIG. 2, which shows the example antenna 10 with sample dimensions. In particular, the dimensions of the slots 16, 18 for a particular embodiment are illustrated. The L-shaped slot 16 has a first section 40 that extends upwards 10.3 mm, and a second section 42 that is 29.8 mm long. The first section 40 is 1.65 mm wide and the second section 42 is 1.18 mm wide.

The C-shaped slot 18 has a first portion 1.1 mm wide and 2.8 mm long, a second portion 1.0 mm wide and 21.35 mm long, a third portion 1.25 mm wide and 5.3 mm long, and a fourth portion 1.1 mm wide and 10.8 mm long. As noted previously, adjustments to the dimensions will impact the impedance and resonance of the slots 16, 18.

The "sections" or "portions" of the slots may also be referred to herein as "parts" of the slots.

The first portion of the C-shaped slot 18 is separated from the first section of the L-shaped slot 16 by 5.3 mm.

The tuning stub, in this embodiment, is 18.3 mm long and 3.7 mm wide. The rectangular portion is approximately 14 mm from its upper edge to its lower edge.

The dimensions for the slots given above and in connection with FIG. 2 have been selected to realize slot resonances in the range of 1.7 GHz to 2.1 GHz band. The resulting wideband functionality of the antenna 10 between 1710 MHz and 2170 MHz provides operability for DCS (Digital Cellular Service), PCS (Personal Communication Service) and UMTS (Universal Mobile Telecommunications System) applications. The dimensions of the tuning stub 14 and the generally rectangular portion 12 realize common mode resonance in the 824-960 MHz band, enabling cellular communications in this band, such as GSM-850, GSM-900, etc. It will be understood that the dimensions shown in FIG. 2 and the corresponding resonances are specific to a given industrial design, including the curvature of the underlying dielectric and the properties of the dielectric. Variations in these features may introduce variations in the resonances and performance of the antenna 10.

Figure 3:
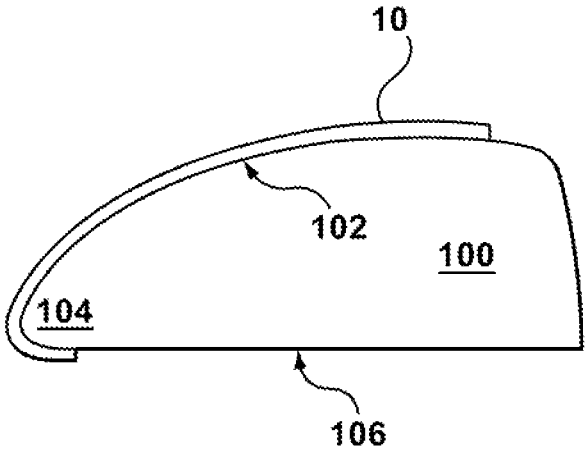
FIG. 3 shows a side view of one embodiment of the antenna.

Reference is now made to FIG. 3, which shows a side view of one embodiment of the antenna 10. In this embodiment, the antenna 10 is supported by a substrate 100. The substrate 100 is a dielectric material, such a suitable non-conducting plastic. The substrate 100 has a curved upper surface 102 to which the antenna 10 is applied, or upon which the antenna 10 is formed. Accordingly, the antenna 10 in this implementation is non-planar. It molds to the curvature of the substrate 100.

The upper surface 102 of the substrate 100 supporting the antenna 10 curves downwards to a corner point 104 and had a substantially planar bottom surface 106.

Figure 4:
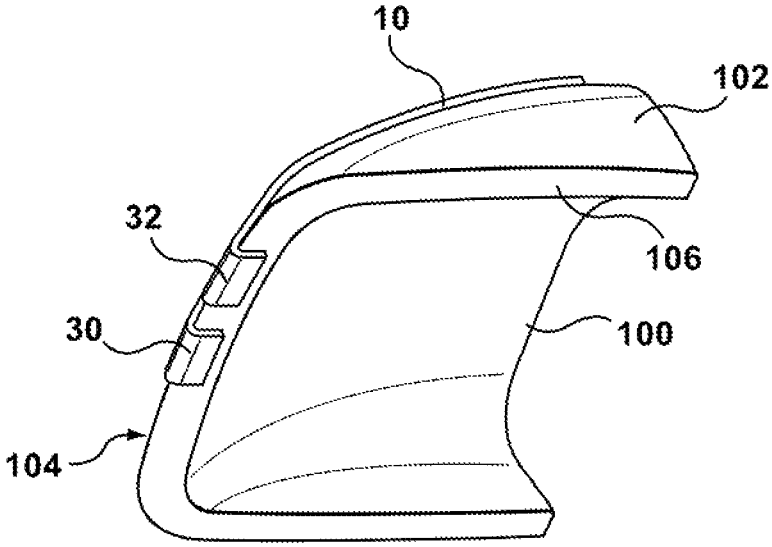
FIG. 4 shows a bottom perspective view of the antenna of FIG. 3.

Reference is now made to FIG. 4, which shows a perspective view of the underside of one embodiment of the substrate 100 and antenna 10. In this embodiment, it will be noted that the substrate 100 does not feature a solid core such that the bottom surface 106 spans the full width and length of the substrate 100. Instead, the substrate 100 forms a shell shape, with the bottom surface 106 running around the perimeter.

The signal feed conductor 30 and the ground conductor 32 are folded over the corner point 104 so as to form tabs visible on the bottom surface 106. The folded tabs of these conductors 30, 32 enable connections with circuitry housed under the substrate, for example by connection to connectors on a printed circuit board. The connection may be made by solder, clips, etc.

Figure 5:
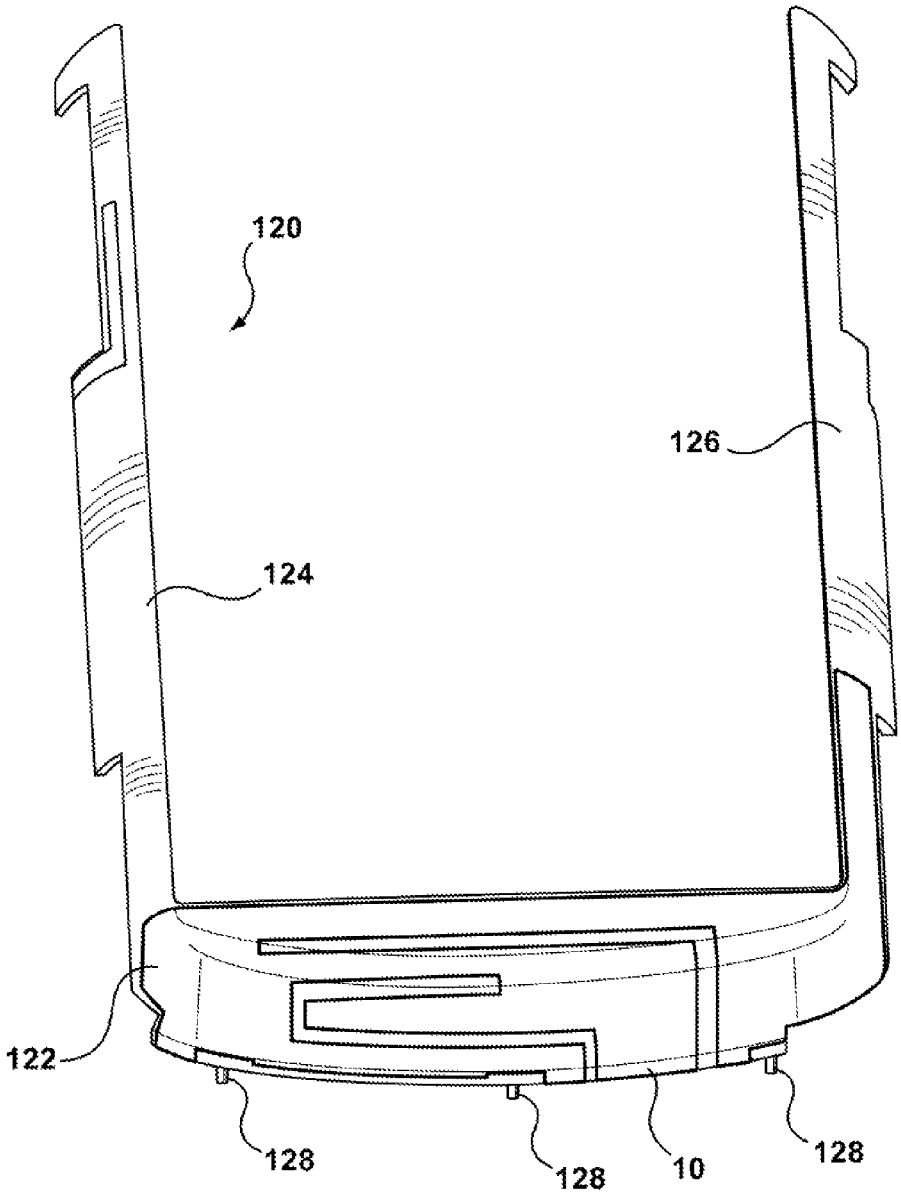
FIG. 5 shows a top perspective view of another embodiment of an antenna.
Figure 6:
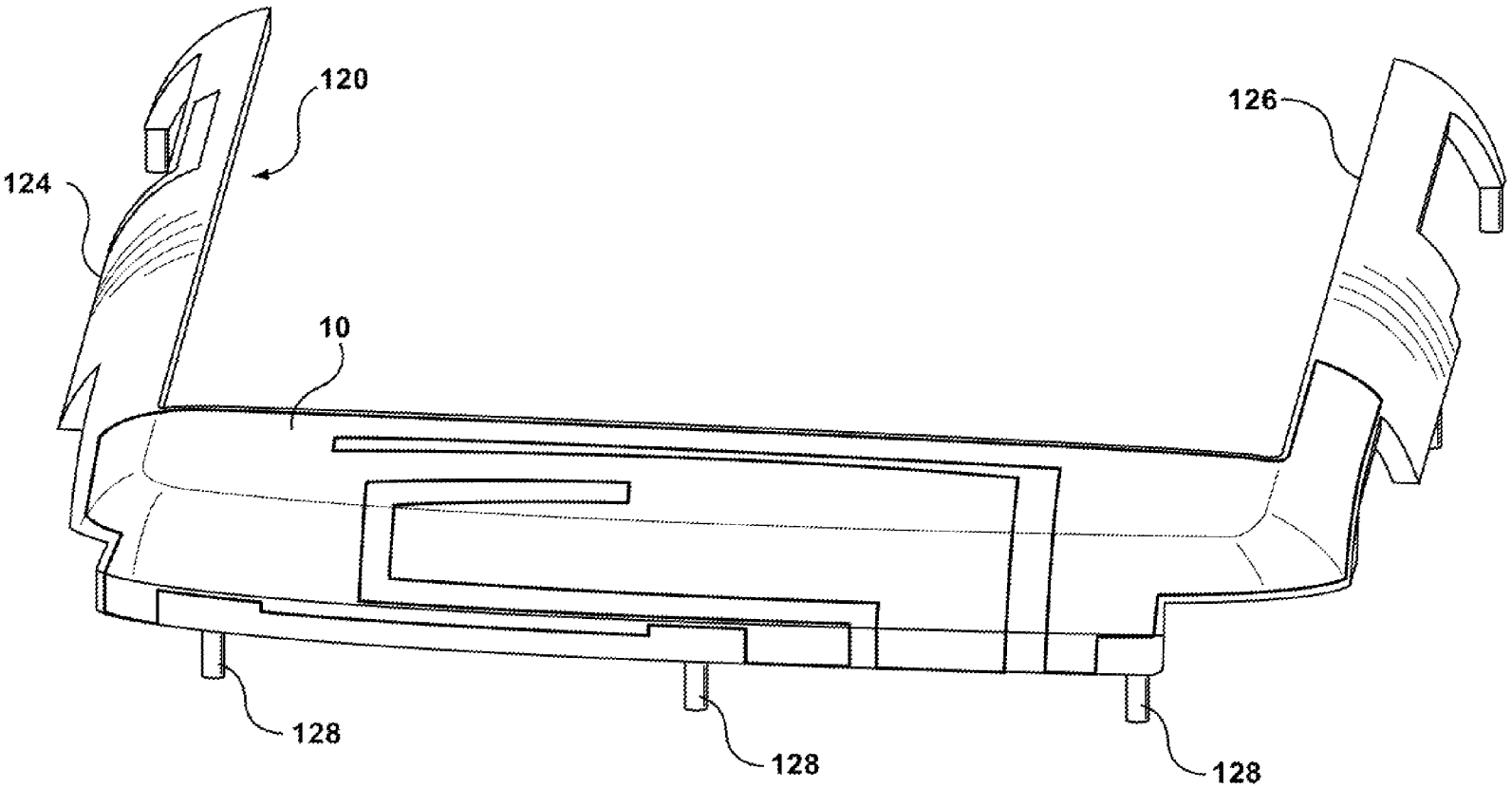
FIG. 6 shows a front perspective view of the antenna of FIG. 5.
Figure 7:
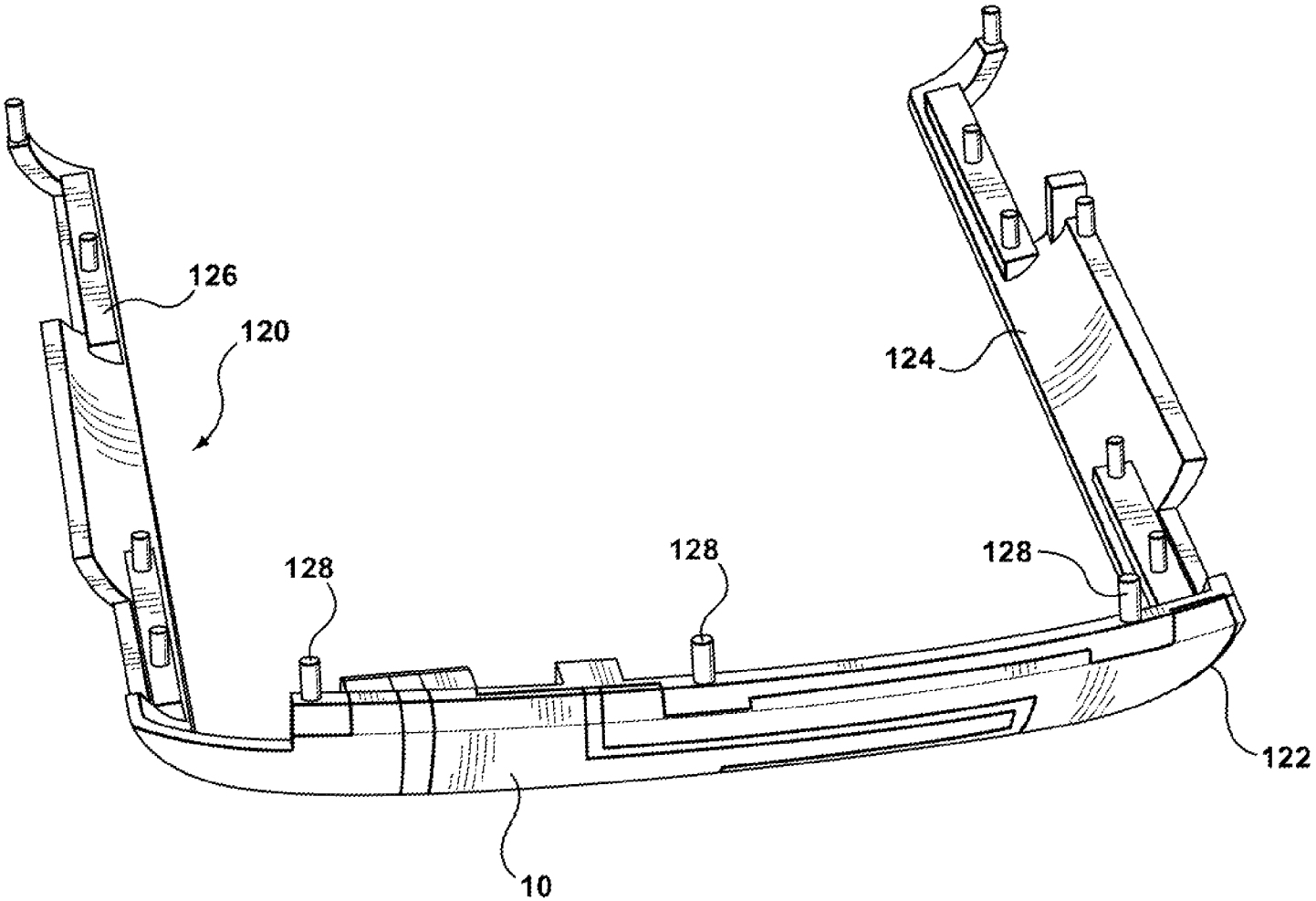
FIG. 7 shows a bottom perspective view of the antenna of FIG. 5.

Reference is now made to FIGS. 5, 6, and 7, which show perspective views of an embodiment of the antenna 10 and a substrate 120. FIG. 5 shows a top perspective view, FIG. 6 shows a front perspective view, and FIG. 7 shows a bottom perspective view. The substrate 120 includes a curved upper surface 122 along its front face and two arms 124, 126 extending back from the front face.

In this embodiment it will be noted that the generally rectangular portion of the patch antenna 10 is not perfectly rectangular. The bottom edge 20, in particular, is not straight; rather, it includes various cutouts, partly to accommodate pins 128. The pins 128 are for securing the substrate 120 within the casing (not shown) of a mobile electronic device, for example. Moreover, the antenna 10 is not planar since it is molded to the curved upper surface 122 of the substrate 120.

As best shown in FIG. 7, the signal feed conductor and ground conductor wrap around the front face of the substrate 120 to the bottom surface, where they are accessible for making connections to components within the mobile electronic device.

Figure 8:
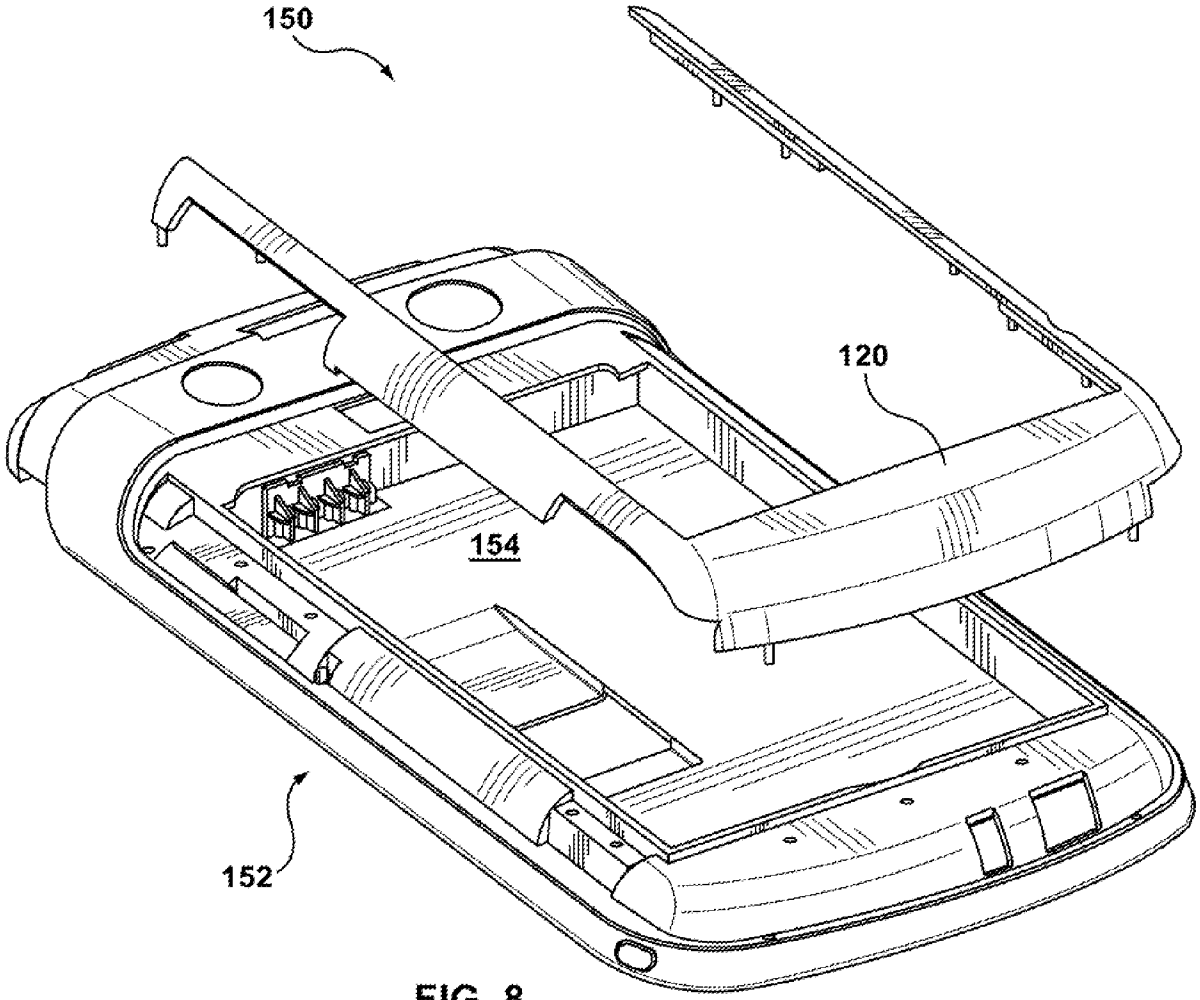
FIG. 8 shows a portion of a mobile device incorporating the antenna of FIG. 5.

Reference is now made to FIG. 8, which shows a portion of an example mobile electronic device 150 in which the antenna 10 may be used. The device 150 includes a housing 152 containing a number of components and having a battery compartment 154 for housing a battery (not shown). The housing 152 is designed to matingly engage with the substrate 120. In particular the pins 128 may be push fit into corresponding holes in the housing 152. Any other method of connecting the housing to the substrate may be used. In other embodiments, the substrate may form part of the housing. In some embodiments, a device casing, including front and back casing plates are designed to fit over the housing 152 and substrate 120. The housing 152 includes appropriate connection points for connecting to the signal feed conductor 30 and ground conductor 32.

The example shown in FIGS. 5 through 8 is one example of a mobile electronic device having a curved surface upon which the antenna 10 may be formed. In other embodiments, supporting substrate surfaces having other shapes or curves may be realized.

Figure 10:
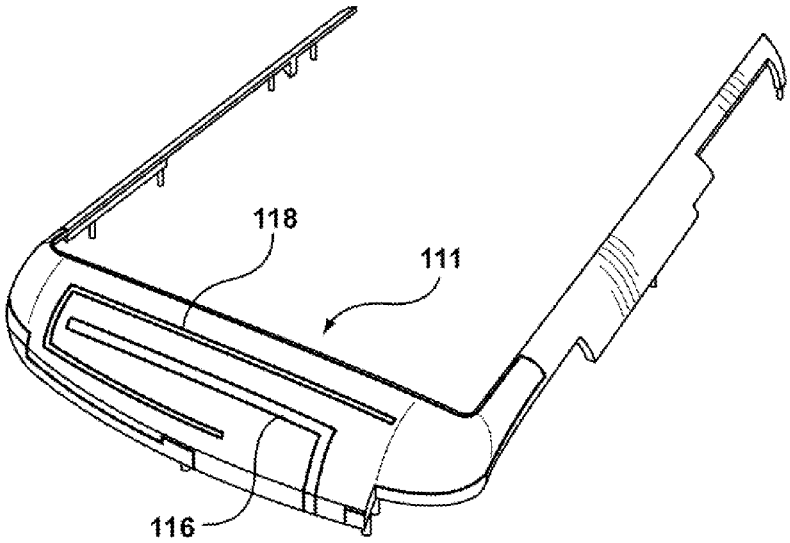
FIG. 10 shows a perspective view of another embodiment of an antenna.

Reference is now made to FIG. 10, which illustrates a perspective view of another embodiment of a multiband patch antenna 111. The multiband patch antenna 111 includes a closed-slot C-shaped slot 118. It will also be noted that the C-shaped slot 118 is positioned such that the L-shaped slot 116 is nested within the C-shaped slot 118. Those skilled in the art will appreciate that the closed-slot C-shaped slot 118 will result in a closed-slot mode resonance different from the open-slot resonance described earlier. In some instances the resonance of the closed-slot is at approximately 2× the frequency of the resonance of an equivalent open-slot.

Figure 9:
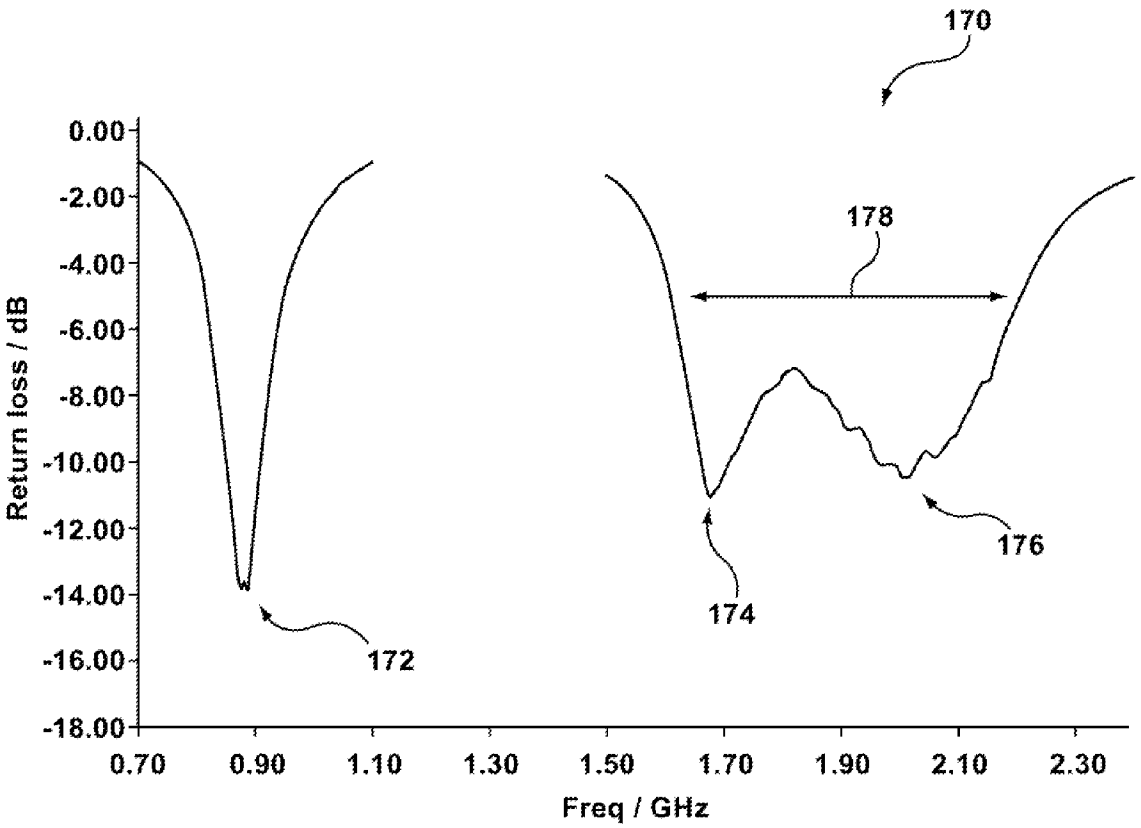
FIG. 9 shows an S11 plot for the antenna of FIG. 6.

Reference is now made to FIG. 9, which shows an example S11 plot 170 obtained for a test antenna having the approximate dimensions detailed in FIG. 6. It will be noted that the plot 170 shows the common mode resonance 172 between 824-960 MHz. It also shows the two slot resonances, 174 and 176, which occur around 1.7 GHz and 2.0 GHz. The two slot resonances 174, 176 combine to provide the wideband resonance 178 that enables wideband operation over a significant frequency range suitable for DCS/PCS/UMTS.

It will be appreciated that an antenna with the response profile shown in FIG. 10 is advantageously possessed of resonance in five operating bands: GSM 800, GSM 900, DCS, PCS, and UMTS.

Figure 11:
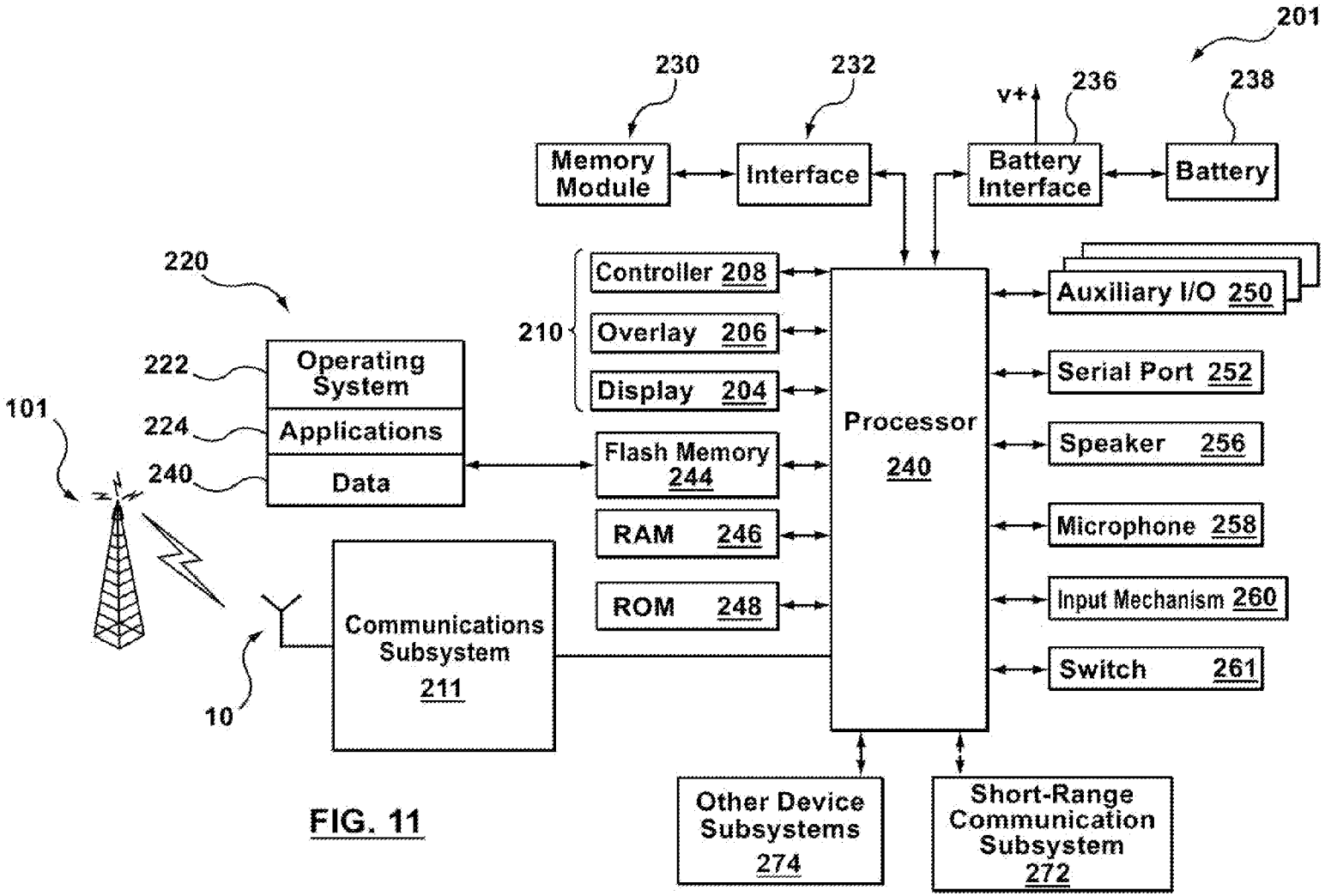
FIG. 11 shows a block diagram of a handheld electronic device incorporating the antenna.

Reference is now made to FIG. 11, which shows an example embodiment of a mobile communication device 201 which may incorporate the antenna 10 described herein. The mobile communication device 201 is a two-way communication device having voice and possibly data communication capabilities; for example, the capability to communicate with other computer systems, e.g., via the Internet. Depending on the functionality provided by the mobile communication device 201, in various embodiments the device may be a multiple-mode communication device configured for both data and voice communication, a smartphone, a mobile telephone or a PDA (personal digital assistant) enabled for wireless communication, or a computer system with a wireless modem.

The mobile communication device 201 includes a controller comprising at least one processor 240 such as a microprocessor which controls the overall operation of the mobile communication device 201, and a wireless communication subsystem 211 for exchanging radio frequency signals with the wireless network 101. The processor 240 interacts with the communication subsystem 211 which performs communication functions. The processor 240 interacts with additional device subsystems. In some embodiments, the device 201 may include a touchscreen display 210 which includes a display (screen) 204, such as a liquid crystal display (LCD) screen, with a touch-sensitive input surface or overlay 206 connected to an electronic controller 208. The touch-sensitive overlay 206 and the electronic controller 208 provide a touch-sensitive input device and the processor 240 interacts with the touch-sensitive overlay 206 via the electronic controller 208. In other embodiments, the display 204 may not be a touch-screen display. Instead, the device 201 may simply include a non-touch display and one or more input mechanisms, such as, for example, a depressible scroll wheel.

The processor 240 interacts with additional device subsystems including flash memory 244, random access memory (RAM) 246, read only memory (ROM) 248, auxiliary input/output (I/O) subsystems 250, data port 252 such as serial data port, such as a Universal Serial Bus (USB) data port, speaker 256, microphone 258, input mechanism 260, switch 261, short-range communication subsystem 272, and other device subsystems generally designated as 274. Some of the subsystems shown in FIG. 11 perform communication-related functions, whereas other subsystems may provide "resident" or on-device functions.

The communication subsystem 211 may include a receiver, a transmitter, and associated components, such as the antenna 10, other antennas, local oscillators (LOs), and a processing module such as a digital signal processor (DSP). The antenna 10 may be embedded or internal to the mobile communication device 201 and a single antenna may be shared by both receiver and transmitter, as is known in the art. As will be apparent to those skilled in the field of communication, the particular design of the communication subsystem 211 depends on the wireless network 101 in which the mobile communication device 201 is intended to operate. As described above, the antenna 10 may be a multi-slot multi-band antenna configured for wideband operation. In one example embodiment, the antenna 10 is configured to operate in at least a first frequency range, such as GSM-900, GSM-850, etc., and to operate in at least a second frequency range, such as bands for DCS/PCS/UMTS communications, like 1710-2170 MHz. By "range", the present application refers to the broad set of frequency bands (both uplink and downlink) intended to be used for wireless communications conforming to a particular standard.

The mobile communication device 201 may communicate with any one of a plurality of fixed transceiver base stations of a wireless network 101 within its geographic coverage area. The mobile communication device 201 may send and receive communication signals over the wireless network 101 after a network registration or activation procedures have been completed. Signals received by the antenna 10 through the wireless network 101 are input to the receiver, which may perform such common receiver functions as signal amplification, frequency down conversion, filtering, channel selection, etc., as well as analog-to-digital (A/D) conversion. A/D conversion of a received signal allows more complex communication functions such as demodulation and decoding to be performed in the DSP. In a similar manner, signals to be transmitted are processed, including modulation and encoding, for example, by the DSP. These DSP-processed signals are input to the transmitter for digital-to-analog (D/A) conversion, frequency up conversion, filtering, amplification, and transmission to the wireless network 101 via the antenna 10.

The processor 240 operates under stored program control and executes software modules 220 stored in memory such as persistent memory, for example, in the flash memory 244. As illustrated in FIG. 11, the software modules 220 comprise operating system software 222 and software applications 224.

Those skilled in the art will appreciate that the software modules 220 or parts thereof may be temporarily loaded into volatile memory such as the RAM 246. The RAM 246 is used for storing runtime data variables and other types of data or information, as will be apparent to those skilled in the art. Although specific functions are described for various types of memory, this is merely one example, and those skilled in the art will appreciate that a different assignment of functions to types of memory could also be used.

The software applications 224 may include a range of other applications, including, for example, a messaging application, a calendar application, and/or a notepad application. In some embodiments, the software applications 224 include an email message application, a push content viewing application, a voice communication (i.e. telephony) application, a map application, and a media player application. Each of the software applications 224 may include layout information defining the placement of particular fields and graphic elements (e.g. text fields, input fields, icons, etc.) in the user interface (i.e. the display device 204) according to the application.

In some embodiments, the auxiliary input/output (I/O) subsystems 250 may comprise an external communication link or interface, for example, an Ethernet connection. The mobile communication device 201 may comprise other wireless communication interfaces for communicating with other types of wireless networks, for example, a wireless network such as an orthogonal frequency division multiplexed (OFDM) network or a GPS transceiver for communicating with a GPS satellite network (not shown). The auxiliary I/O subsystems 250 may comprise a vibrator for providing vibratory notifications in response to various events on the mobile communication device 201 such as receipt of an electronic communication or incoming phone call, or for other purposes such as haptic feedback (touch feedback).

In some embodiments, the mobile communication device 201 also includes a removable memory card 230 (typically comprising flash memory) and a memory card interface 232.

Network access may be associated with a subscriber or user of the mobile communication device 201 via the memory card 230, which may be a Subscriber Identity Module (SIM) card for use in a GSM network or other type of memory card for use in the relevant wireless network type. The memory card 230 is inserted in or connected to the memory card interface 232 of the mobile communication device 201 in order to operate in conjunction with the wireless network 101.

The mobile communication device 201 stores data 240 in an erasable persistent memory, which in one example embodiment is the flash memory 244. In various embodiments, the data 240 includes service data comprising information required by the mobile communication device 201 to establish and maintain communication with the wireless network 101. The data 240 may also include user application data such as email messages, address book and contact information, calendar and schedule information, notepad documents, image files, and other commonly stored user information stored on the mobile communication device 201 by its user, and other data. The data 240 stored in the persistent memory (e.g. flash memory 244) of the mobile communication device 201 may be organized, at least partially, into a number of databases each containing data items of the same data type or associated with the same application.

The serial data port 252 may be used for synchronization with a user's host computer system (not shown). The serial data port 252 enables a user to set preferences through an external device or software application and extends the capabilities of the mobile communication device 201 by providing for information or software downloads to the mobile communication device 201 other than through the wireless network 101. The alternate download path may, for example, be used to load an encryption key onto the mobile communication device 201 through a direct, reliable and trusted connection to thereby provide secure device communication.

In some embodiments, the mobile communication device 201 is provided with a service routing application programming interface (API) which provides an application with the ability to route traffic through a serial data (i.e., USB) or Bluetooth® (Bluetooth® is a registered trademark of Bluetooth SIG, Inc.) connection to the host computer system using standard connectivity protocols. When a user connects their mobile communication device 201 to the host computer system via a USB cable or Bluetooth® connection, traffic that was destined for the wireless network 101 is automatically routed to the mobile communication device 201 using the USB cable or Bluetooth® connection. Similarly, any traffic destined for the wireless network 101 is automatically sent over the USB cable Bluetooth® connection to the host computer system for processing.

The mobile communication device 201 also includes a battery 238 as a power source, which is typically one or more rechargeable batteries that may be charged, for example, through charging circuitry coupled to a battery interface such as the serial data port 252. The battery 238 provides electrical power to at least some of the electrical circuitry in the mobile communication device 201, and the battery interface 236 provides a mechanical and electrical connection for the battery 238. The battery interface 236 is coupled to a regulator (not shown) which provides power V+ to the circuitry of the mobile communication device 201.

The short-range communication subsystem 272 is an additional optional component which provides for communication between the mobile communication device 201 and different systems or devices, which need not necessarily be similar devices. For example, the subsystem 272 may include an infrared device and associated circuits and components, or a wireless bus protocol compliant communication mechanism such as a Bluetooth® communication module to provide for communication with similarly-enabled systems and devices.

A predetermined set of applications that control basic device operations, including data and possibly voice communication applications will normally be installed on the mobile communication device 201 during or after manufacture. Additional applications and/or upgrades to the operating system 221 or software applications 224 may also be loaded onto the mobile communication device 201 through the wireless network 101, the auxiliary I/O subsystem 250, the serial port 252, the short-range communication subsystem 272, or other suitable subsystem 274 other wireless communication interfaces. The downloaded programs or code modules may be permanently installed, for example, written into the program memory (i.e. the flash memory 244), or written into and executed from the RAM 246 for execution by the processor 240 at runtime. Such flexibility in application installation increases the functionality of the mobile communication device 201 and may provide enhanced on-device functions, communication-related functions, or both. For example, secure communication applications may enable electronic commerce functions and other such financial transactions to be performed using the mobile communication device 201.

The wireless network 101 may comprise one or more of a Wireless Wide Area Network (WWAN) and a Wireless Local Area Network (WLAN) or other suitable network arrangements. In some embodiments, the mobile communication device 201 is configured to communicate over both the WWAN and WLAN, and to roam between these networks. In some embodiments, the wireless network 101 may comprise multiple WWANs and WLANs. In some embodiments, the mobile device 201 includes the communication subsystem 211 for WWAN communications and a separate communication subsystem for WLAN communications. In most embodiments, communications with the WLAN employ a different antenna than communications with the WWAN. Accordingly, the antenna 10 may be configured for WWAN communications or WLAN communications depending on the embodiment and desired application.

In some embodiments, the WWAN conforms to one or more of the following wireless network types: Mobitex Radio Network, DataTAC, GSM (Global System for Mobile Communication), GPRS (General Packet Radio System), TDMA (Time Division Multiple Access), CDMA (Code Division Multiple Access), CDPD (Cellular Digital Packet Data), iDEN (integrated Digital Enhanced Network), EvDO (Evolution-Data Optimized) CDMA2000, EDGE (Enhanced Data rates for GSM Evolution), UMTS (Universal Mobile Telecommunication Systems), HSPDA (High-Speed Downlink Packet Access), IEEE 802.16e (also referred to as Worldwide Interoperability for Microwave Access or "WiMAX), or various other networks. Although WWAN is described as a "Wide-Area" network, that term is intended herein also to incorporate wireless Metropolitan Area Networks (WMAN) and other similar technologies for providing coordinated service wirelessly over an area larger than that covered by typical WLANs.

The WLAN comprises a wireless network which, in some embodiments, conforms to IEEE 802.11x standards (sometimes referred to as Wi-Fi) such as, for example, the IEEE 802.11a, 802.11b and/or 802.11g standard. Other communication protocols may be used for the WLAN in other embodiments such as, for example, IEEE 802.11n, IEEE 802.16e (also referred to as Worldwide Interoperability for Microwave Access or "WiMAX"), or IEEE 802.20 (also referred to as Mobile Wireless Broadband Access). The WLAN includes one or more wireless RF Access Points (AP) that collectively provide a WLAN coverage area.

Certain adaptations and modifications of the described embodiments can be made. Therefore, the above discussed embodiments are considered to be illustrative and not restrictive.

What is claimed is:

1. A radio frequency multi-band patch antenna having a lower edge, the patch antenna comprising:

a conductive material on a surface of a substrate;

the conductive material defining a first slot including:

a first linear first-slot section projecting perpendicularly from the lower edge, into the patch antenna, to an inner end; and a second linear first-slot section projecting from the inner end in a direction parallel to the lower edge;

the conductive material defining a second slot including:

a first second-slot section projecting perpendicularly from the lower edge of the patch antenna into the patch antenna to a first end that is proximal to the first linear first-slot section;

a second second-slot section projecting from the first end parallel to the lower edge to a second end distal from the first linear first-slot section;

a third second-slot section projecting, from the second end perpendicular to the lower edge, in a direction away from the lower edge to a third end; and a fourth second-slot section projecting, from the third end in a direction parallel to the lower edge, toward the first linear first-slot section, the fourth second-slot section having a length less than a length of the second second-slot section;

wherein the first linear first-slot section is dimensioned to be longer than the first second-slot section and the third second-slot section together; and wherein the first, second, third and fourth second-slot sections are disposed between the second linear first-slot section and the lower edge of the patch antenna, such that the second slot is nested entirely within the first slot.

2. The radio frequency multi-band patch antenna of claim 1, wherein a signal feed conductor connects to the lower edge of the patch antenna on a first side of the first linear first-slot section and a ground conductor, connecting the patch antenna to a ground plane, connects to the lower edge of the patch antenna on a second side of the first linear first-slot section.

3. The radio frequency multi-band patch antenna of claim 2, wherein the second slot is disposed on the first side of the first linear first-slot section.

4. The radio frequency multi-band patch antenna of claim 3, wherein the signal feed conductor is connected to the lower edge between the first slot and the second slot.

5. The radio frequency multi-band patch antenna of claim 4, wherein the patch antenna has a left side and right side, and wherein the size of the left side tunes a common mode resonance, and wherein the size of the right side tunes the common mode resonance and slot resonances.

6. The radio frequency multi-band patch antenna of claim 1, wherein the conductive material includes a main patch and a tuning stub projecting from the patch antenna at an upper edge thereof.

7. The radio frequency multi-band patch antenna of claim 6, wherein the tuning stub comprises a patch smaller than the main patch.

8. The radio frequency multi-band patch antenna of claim 6, wherein the patch antenna and tuning stub are dimensioned to have a common mode resonance between 824 MHz and 960 MHz, and wherein the slots are dimensioned to have slot resonances between 1710 MHz and 2170 MHz.

9. The radio frequency multi-band patch antenna of claim 1, wherein the substrate is disposed in a back bottom region of a mobile communications device.

* * * * *